US007779854B2

(12) United States Patent
Lewis et al.

(10) Patent No.: US 7,779,854 B2
(45) Date of Patent: Aug. 24, 2010

(54) VALVE MEMBER TO ARMATURE COUPLING SYSTEM AND FUEL INJECTOR USING SAME

(75) Inventors: Stephen R. Lewis, Chillicothe, IL (US); Dana R. Coldren, Secor, IL (US); Amy Johanson, Normal, IL (US); Jeffrey Mueller, Bloomington, IL (US); Eric L. Rogers, El Paso, IL (US)

(73) Assignee: Caterpillar Inc, Peoria, IL (US)

( * ) Notice: Subject to any disclaimer, the term of this patent is extended or adjusted under 35 U.S.C. 154(b) by 793 days.

(21) Appl. No.: 11/652,877

(22) Filed: Jan. 12, 2007

(65) Prior Publication Data

US 2008/0169366 A1 Jul. 17, 2008

(51) Int. Cl.
*F02M 51/06* (2006.01)

(52) U.S. Cl. ..... 137/15.18; 137/315.27; 251/129.16; 239/585.3

(58) Field of Classification Search ..... 137/315.27, 137/15.18; 251/129.15, 129.21, 129.16; 239/585.1, 585.2, 585.3, 585.5
See application file for complete search history.

(56) References Cited

U.S. PATENT DOCUMENTS 4,905,960 A * 3/1990 Barnhart et al. ..... 251/129.18
6,224,033 B1 * 5/2001 Kumar ..... 251/129.16
6,892,967 B2 * 5/2005 Tappolet et al. ..... 239/585.1
2001/0025940 A1 10/2001 Kumar
2003/0102386 A1 6/2003 Sebastian
2004/0000600 A1 1/2004 Peters et al.
2006/0202151 A1 9/2006 Lewis et al.

FOREIGN PATENT DOCUMENTS

GB 1 372 207 10/1974

* cited by examiner

*Primary Examiner*—Kevin L Lee
(74) *Attorney, Agent, or Firm*—Liell & McNeil

(57) ABSTRACT

A relatively inexpensive robust attachment strategy that insures good perpendicularity between a valve member and an armature utilizes an intervening nut between the armature and valve member. A valve member is received in a guide bore of a valve body. A nut is threaded onto one end of a valve member. The armature is press fit onto a orientation neutral interface of the nut, and a fixture is utilized to set near perfect perpendicularity between an air gap plane of the armature and a centerline of the valve member. The armature is then welded to the valve member. The weld may be accomplished via laser welding while the valve assembly is firmly held in an appropriate position within the fixture. The valve assembly may be then incorporated into a fuel injector stack of components in a conventional manner.

20 Claims, 4 Drawing Sheets

VALVE MEMBER TO ARMATURE COUPLING SYSTEM AND FUEL INJECTOR USING SAME

TECHNICAL FIELD

The present disclosure relates generally to solenoid actuated valves, and more particularly to a method of joining a valve member to an armature via an intervening nut.

BACKGROUND

Fuel Injectors typically utilize one or more electronically controlled valves to control fuel injection quantity and timing independent of engine crank angle. In some instances, the electronically controlled valve takes on a typical structure that utilizes a relatively hard non-magnetic valve member that is attached by some means to a relatively soft magnetic armature. When a solenoid coil is energized, the armature is drawn toward the coil, and the valve member is moved toward or away from a valve seat. Because of many factors including the high number of impact cycles, the presence of liquid around the armature, acceleration from the coil and inertia factors, making a robust attachment strategy between the armature and the valve member to survive this hostile environment over many millions of actuation cycles, and do so at a reasonable cost, can be somewhat problematic.

Besides the repeated accelerations and decelerations encountered by these electronically controlled valves, other problems have been associated with consistently manufacturing large quantities of valves with relatively small air gaps that allow for relatively short valve travel distances. Those skilled in the art recognize that short travel distances are often desirable since they correlate closely to quick valve response times. Thus, insuring good perpendicularity between the armature and the valve member can allow for tighter tolerances and reduced air gap distances, and a corresponding decrease in valve response time.

In one previous valve assembly structure that addressed these problems, the valve member included an annular shoulder upon which a spacer would be supported. An armature having a guide clearance with the valve member sits atop the spacer with a relatively tight guide clearance. The perpendicular plane of the shoulder and the tight guide clearance supposedly insure good perpendicularity. Atop the armature is another spacer followed by a threaded nut that would hold the two spacers and armature securely against the shoulder of the valve member. While such a solution provides adequate long term robustness to withstand the repeated accelerations and decelerations, relying upon interactions between supposedly perpendicular surfaces on the components themselves to insure perpendicular geometry, especially at edges of the armature remote from the valve member centerline can be more problematic.

Another potential solution, which is taught in co-owned U.S. patent application Ser. No. 11/073,571, filed Mar. 8, 2005, teaches the idea of using an orientation neutral interface between the armature and the valve member, utilizing a fixture to arrange the pieces with good perpendicularity, and then welding the armature directly to the valve member. While such a strategy probably improves upon the perpendicularity issues of the previously discussed strategy, the welded joint between the armature and the valve member may not be as robust as the usage of a nut and spacers. An orientation neutral interface might be one in which the valve member includes an annular raised rounded portion upon which the armature can be press fit in a variety of orientations (plus or minus a fraction of a degree) to allow for setting in a fixture to achieve relatively near perfect perpendicularity. This alternative also has the undesirable feature of having to leave a portion of the valve member less heat treat hardened in order to make it "weldable." While this strategy has shown promise, a valve member with a relatively small diameter reduces the amount of weld interface available, which may not provide as robust an attachment as other strategies.

The present disclosure is directed toward one or more of the problems set forth above.

SUMMARY OF THE DISCLOSURE

In one aspect, a valve assembly includes a valve body having a contact surface defining a stacking plane. A valve member with a shoulder stop and a set of external threads is received in the valve body. A nut is threadably attached to the set of external threads at a first diameter with the nut in contact with the shoulder stop. An armature is affixed to the nut at a second, larger diameter, and has a surface defining an air gap plane parallel separated from the stacking plane by an air gap distance.

In another aspect, a fuel injector includes an injector body with a stack of components that include a valve body of a valve assembly in contact between a coil component and a needle control component at first and second stacking planes, respectively, that are parallel to each other. The valve assembly includes a valve member with a set of external threads and a shoulder stop. A nut is threadably attached to the set of external threads at a first diameter and in contact with the shoulder stop. An armature is affixed to the nut at a second, larger diameter, and has a surface defining an air gap plane parallel separated from the first stacking plane by an air gap.

In still another aspect, a method of assembling a valve for a fuel injector includes inserting a threaded end of a valve member through a guide bore of a valve body. A nut is threaded onto the threaded end of the valve member until the nut contacts a shoulder stop on the valve member. A surface of an armature that defines an air gap plane if positioned in parallel with, and at an air gap distance from, a stacking plane defined by a contact surface of the valve body. The armature is fit onto the outer surface of the nut with an interference fit, and then the armature is affixed to the nut via a weld.

DETAILED DESCRIPTION

Figure 1:
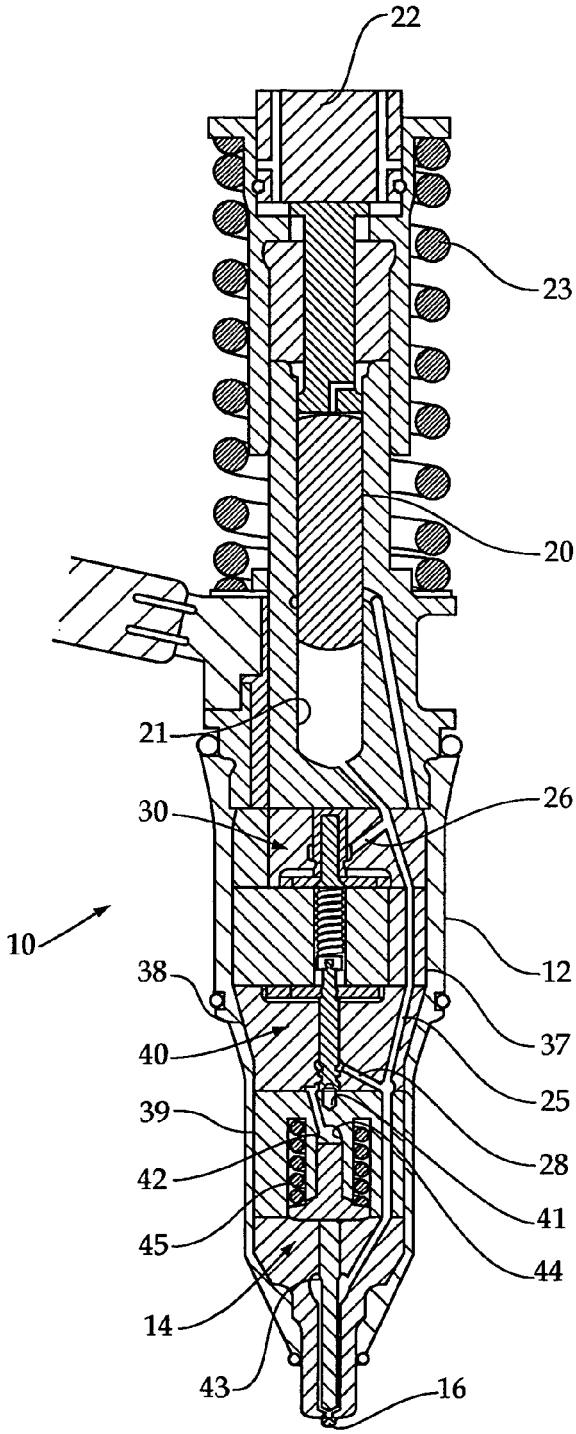
FIG. 1 is a sectioned side diagrammatic view of a fuel injector according to one aspect of the present disclosure.

Referring to FIG. 1, a fuel injector 10 includes an injector body 12 within which a direct control needle valve 14 is positioned that controls the opening and closing of nozzle outlets 16. Fuel injector 10 includes a plunger 20 that is operably coupled to a cam tappet 22 to compress fuel to injection pressure levels in a plunger cavity 21. A return spring 23 maintains cam tappet 22 operably coupled to a rotating cam. In the illustrated embodiment, plunger 20 is a free floating plunger such that the medium pressure fuel supplied to the injector between injection events pushes plunger 20 upward to follow cam tappet 22 and refill plunger cavity 21 for a subsequent injection event. When plunger 20 is driven downward, fuel in plunger cavity 21 is raised in pressure to injection levels, and is supplied to nozzle outlet 16 via a nozzle supply passage 25. However, timing of when pressure develops in plunger cavity 21 is controlled by an electronically controlled spill valve 30 that is fluidly connected to nozzle supply passage 25 via a spill passage 26. Thus, when plunger 20 is being driven downward, fuel is displaced at relatively low pressure from plunger cavity 21 through spill valve 30 via spill passage 26 as long as spill valve 30 is opened. The opening and closing of nozzle outlets 16 is controlled by a second electronic controlled valve or needle control valve 40 that controls a pressure in pressure control chamber 44. In particular, the needle control valve assembly 40 may be moved between a first position in which pressure control chamber 44 is fluidly connected to the pressure in nozzle supply passage 25 via a pressure communication passage 28, or a second position at which the pressure control chamber 44 is fluidly connected to low pressure passage 41, and fluidly disconnected from the pressure in pressure communication passage 28. The pressure in pressure control chamber 44 acts upon a closing hydraulic surface 42 of direct control needle valve 14, which is in opposition to an opening force on opening hydraulic surface 43, which is exposed to fluid pressure in nozzle supply passage 25. Direct control needle valve 14 is normally biased downward toward a closed position via a needle biasing spring 45. The closing hydraulic surface 42 and opening hydraulic surface 43 are sized, and a preload on needle biasing spring 45 is chosen, such that when high pressure exists in nozzle supply passage 25, the direct control needle valve 14 will lift to an open position when pressure control chamber 44 is fluidly connected to low pressure passage 41. On the other hand, when needle control valve assembly 40 fluidly connects pressure control chamber 44 to high pressure in pressure communication passage 28, direct control needle valve 14 will stay in or move toward its closed position as shown.

Figure 2:
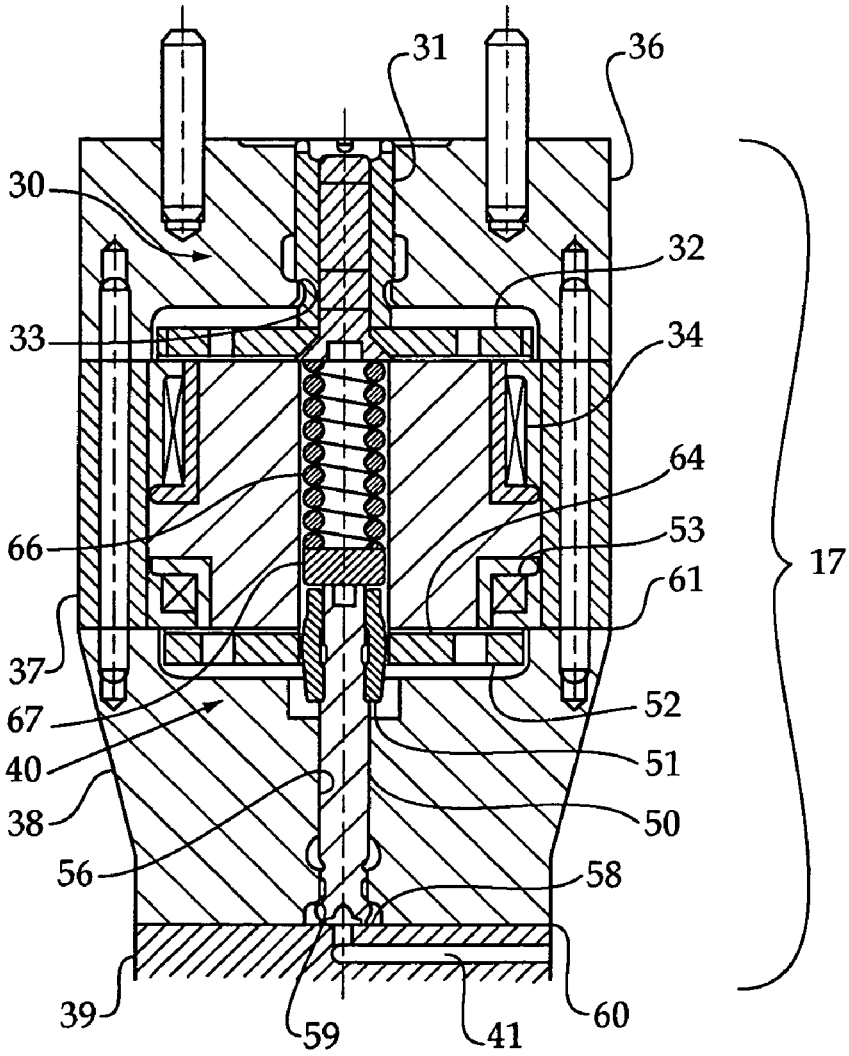
FIG. 2 is a sectioned side diagrammatic view of the control valves of the fuel injector of FIG. 1.

Referring in addition to FIG. 2, a portion of the fuel injector internal stack 17 associated with spill control valve 30 and needle control valve assembly 40 are illustrated. Those skilled in the art will appreciate that conventional fuel injector construction involves a plurality of stacked components that contact each other in planes perpendicular to a clamping force provided by a threaded attachment between an upper body component and an outer casing component in a conventional manner. As shown in FIG. 2, spill control valve 30 includes a valve member 31 that is biased toward an open position out of contact with seat 33 via a biasing spring 66. Valve member 31 is attached to an armature 32, which is moved by energizing a coil 34. Valve member 31 is positioned to move within spill valve component 36, which is one of several components in the fuel injector stack 17. The spill valve component 36 is in contact with coil component 37 so that when valve member 31 is in contact with valve seat 33, an air gap exists between armature 32 and the coil component 37.

In addition to the coil 34 associated with spill valve 30, coil component 37 includes a second coil 53 associated with needle control valve assembly 40. In that instance, coil component 37 is in contact with valve assembly component 38 at a stacking plane 61. Valve assembly 40 includes a valve member 50 in sliding guide contact with valve assembly component 38 at a guide bore 36. In order to improve performance, valve member 50 may be hardened, especially at its valving surfaces. This hardening may render portions, or all, of valve member 50 "unweldable" and non magnetic. A nut 51 is attached to valve member 50, and an armature 52 is affixed to nut 51 such that an air gap plane 64 is created between armature 52 and the underside or stacking plane 61 of coil component 37. The material of the armature may be soft, weldable and magnetic relative to the valve member 50. There is no direct contact between armature 52 and valve member 50. The valve assembly component 38 is in contact with needle control component 39 at a stacking plane 60. The upper surface or stacking plane 60 of needle control component 39 defines a flat seat 58. Valve member 50 is trapped to move between flat seat 58 and a conical seat 59. In other alternative embodiments one of the seats could be a simple stop surface, and the conical seat could be substituted for the flat seat, and vice versa. When in contact with conical seat 59, the pressure control chamber 44 (FIG. 1) is fluidly connected to low pressure passage 41. When valve member 50 is in contact with flat seat 58, pressure control chamber 44 is in fluid communication with the pressure in pressure communication passage 28, which is high during an injection cycle. A preload spacer 67 sits atop nut 51 and is used to set the preload on biasing spring 66, which is shared by spill valve 30 and needle control valve assembly 40. Thus, valve member 50 is normally biased downward into contact with flat seat 58 when coil 53 is de-energized. When coil 53 is energized, armature 52 is pulled upward to reduce, but not close the air gap between air gap plane 64 and stacking plane 61, and bring valve member 50 into contact with conical seat 59.

Figure 3:
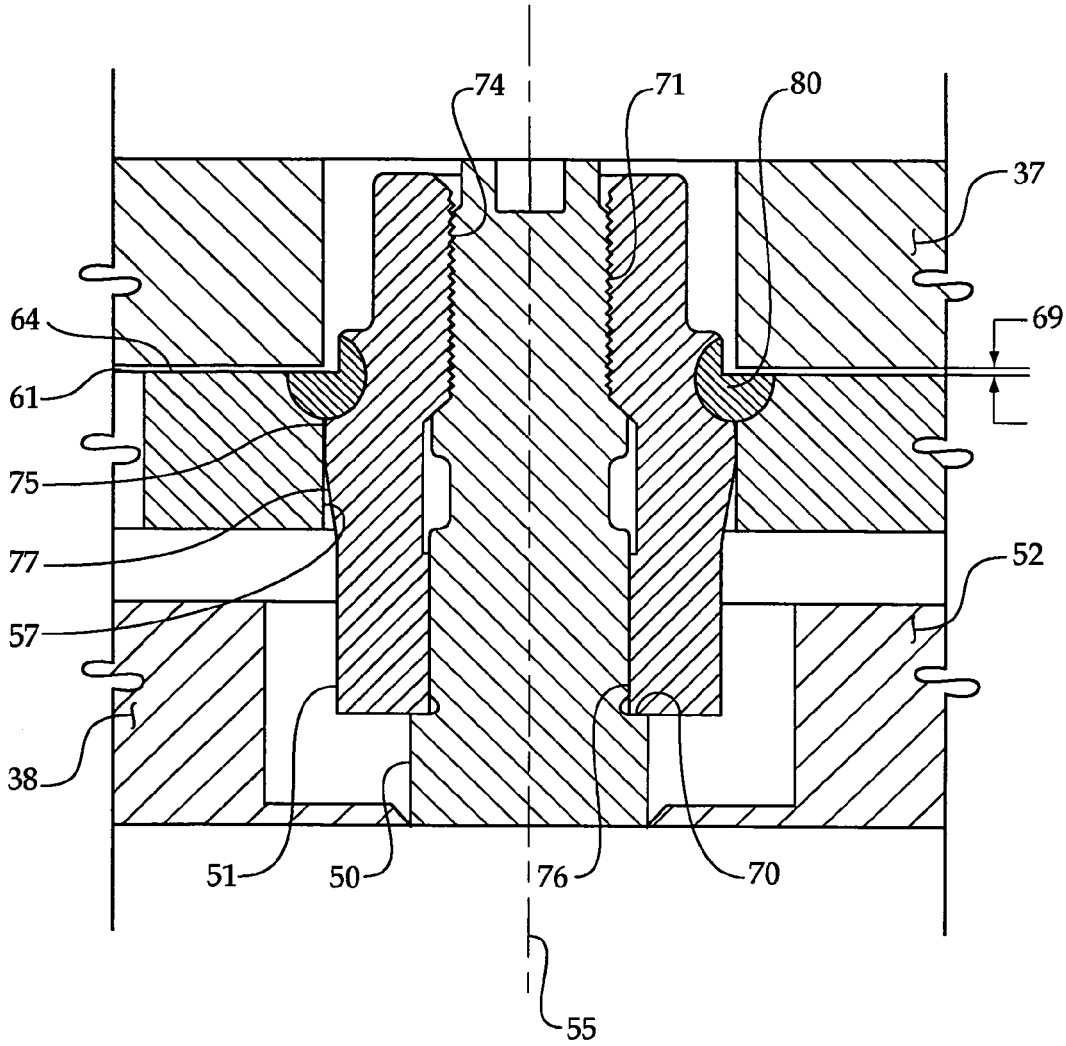
FIG. 3 is a close up sectioned side diagrammatic view of the armature/nut/valve member attachment interface from the valve assembly of FIG. 2.

Referring in addition to FIG. 3, the attachment strategy between armature 52, nut 51 and valve member 50 is illustrated. In particular, nut 51 is threaded onto valve member 50 via an interaction of internal threads 74 with external threads 71, and is guided in this movement via an interaction with guide surface 76. Nut 51 is normally advanced onto valve member 50 until is contacts a shoulder stop 70, which lays in a plane perpendicular to valve member centerline 55. Nut 51 and armature 52 include an orientation neutral interface 75, which in the illustrated embodiment takes on the form of nut 51 having an annular radius surface that may be press fit into contact with a cylindrical bore of armature 52. This allows armature 52 to have an orientation such that its air gap plane 64 can be adjusted with respect to valve member centerline 55. This allows for precisely setting the perpendicularity between armature air gap plane 64 and centerline 55 to define an air gap distance 69. Air gap distance 69 is the distance between air gap plane 64 and stacking plane 61 which is defined by the contact between coil component 37 and valve assembly component 38. Thus, the diameter of cylindrical bore 57 along with the diameter of annular raised surface 77 allow for an interference fit between armature 52 and nut 51. This interference fit allows the two pieces to be oriented appropriately before being joined with an annular laser weld 80 that extends completely around the periphery of nut 51.

INDUSTRIAL APPLICABILITY

Figure 4:
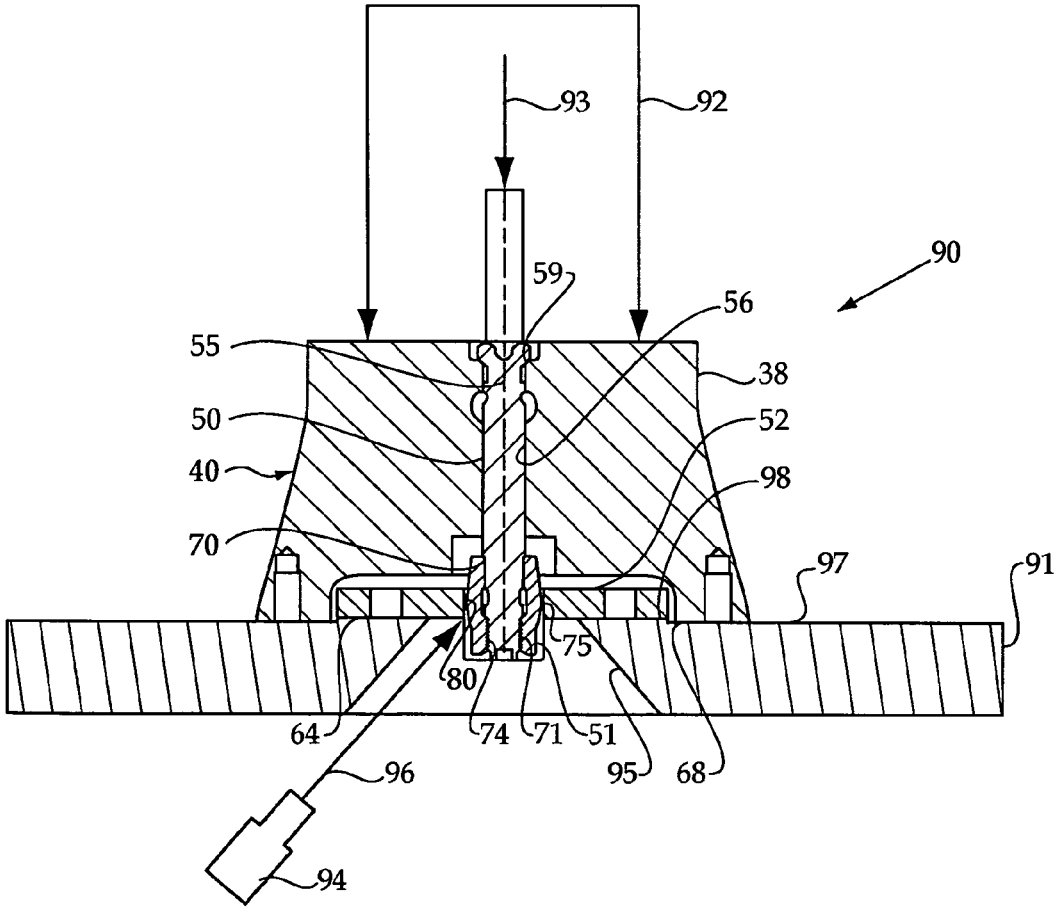
FIG. 4 is a side schematic view of a fixture and valve assembling strategy for the valve assembly shown FIGS. 1-3.

Referring to FIG. 4, needle control valve assembly 40 is shown positioned in a fixture 90 that is utilized to set the perpendicularity between air gap plane 64 and centerline 55, as well as set the air gap distance 69 (FIG. 3). Those skilled in the art will appreciate that fixture 90 may be a completely manually operated device at one extreme, or may be a portion of a completely automated robotic assembly machine at another extreme without departing from the scope of the present disclosure. Fixture 90 includes a table 91 that defines a stacking plane support surface 97 and an elevated air gap plane support surface 98. Surfaces 97 and 98 are parallel with one another and separated by a distance corresponding to the desired minimum air gap between air gap plane 64 and stacking plane 68 when valve member 50 is in contact with conical valve seat 59.

The assembly of needle control valve assembly 40 is initiated by inserting the threaded end 71 of valve member 50 through guide bore 56. Next, nut 51 is threaded onto valve member 50 until it contacts shoulder stop 70. Meanwhile, an armature 52 is placed on and in contact with elevated air gap plane support surface 98. Next, the nut is advanced into cylindrical bore 57 (FIG. 3), of armature 52 and valve assembly component 38 is brought into contact with stacking plane support surface 97. Next, the subassembly is clamped to table 91 via a clamp 92 that holds stacking plane 68 in contact with stacking plane support surface 97. Next, a press fitting device 93 acts upon the bottom surface of valve member 50 and advances valve member 50 and nut 51 into an interference fit with armature 52. By exploiting the perpendicularity that exists between guide bore 56 and stacking plane 68, along with the orientation neutral interface 75 between armature 52 and nut 51, a near perfect perpendicularity interference fit can be set between air gap plane 64 and valve member centerline 55. The valve member 50 is advanced into this interference until it is stopped by contacting conical valve seat 59. While still clamped in fixture 90, a laser welder 94 directs a laser beam 96 at a weld location 80 via a laser access opening 95 in Table 91. Either fixture 90 or laser welder 94 are then rotated about valve member centerline 55 to complete the annular weld between nut 51 and armature 52 completely around nut 51. After this is done, the press fitting device 93 lifts out of contact with valve member 50 and the clamp 92 is released. Next, the valve assembly 40 is removed from fixture 90, and is ready for installation in fuel injector stack 17 in proper order in a conventional manner. Those skilled in the art will appreciate that other affixing strategies, such as inertia welding, brazing or other suitable means are within the scope of this discloser.

Since the nut 51 presents a larger diameter weld with respect to armature 52 than if the armature were welded directly to valve member 50, a substantially strengthened attachment can be created. In addition, not only is there a larger weld, but some of the repeated acceleration and decelerations applied to armature 52 and valve member 50 may be absorbed by the threaded attachment between nut 52 and valve member 50. In addition, by utilizing an orientation neutral interface 75 between the nut 51 and armature 52, the perpendicularity between the air gap plane 64 of the armature 52 and the centerline 55 of the valve member 50 can be set with great precision, especially when utilizing a fixture as shown. In addition, this attachment strategy results in a reduction of parts associated with a previous strategy that utilized two spacers, and allows for a more precise setting of the air gap plane to valve member centerline perpendicularity. Thus, the attachment strategy taught produces a robust attachment that has a higher level of orientation precision, and this all is accomplished with a reduced number of parts, and an associated reduction in cost. In addition, because of the larger diameter weld location afforded by nut 52, the disclosed attachment strategy represents a substantially more robust attachment than if the armature were simply welded directly to the valve member at a relatively smaller diameter. In addition, the strategy of the present disclosure also allows for less special care being taken in heat treat hardening of valve member 50, since no welds will be made to the valve member, and the armature is separated and out of contact with the valve member via the intervening nut 51. In addition, the material utilized for the nut can be chosen without compromise for improved welding strength, which further allows for a robust connection.

It should be understood that the above description is intended for illustrative purposes only, and is not intended to limit the scope of the present invention in any way. Thus, those skilled in the art will appreciate that other aspects of the invention can be obtained from a study of the drawings, the disclosure and the appended claims. Although the valve assembly of the present disclosure has been shown in the context of a cam driven fuel injector, those skilled in the art will appreciate that the valve assembly could be utilized in other fuel injectors, including hydraulically actuated, or common rail fuel injectors, and could find potential application in many valving applications outside the fuel injector arena where repeated accelerations and decelerations can fatigue a connection strategy between a relatively soft magnetic armature and a relatively hard non-magnetic valve member.

What is claimed is:

1. A valve assembly comprising:

a valve body having a contact surface defining a stacking plane;

a valve member with a shoulder stop and a set of external threads is received in the valve body;

a nut threadably attached to the set of external threads at a first diameter and in contact with the shoulder stop; and an armature affixed to the nut at a second, larger diameter, and having a surface defining an air gap plane parallel separated from the stacking plane by an air gap distance.

2. The valve assembly of claim 1 wherein the armature is in contact with the nut over an orientation neutral interface.

3. The valve assembly of claim 1 wherein the nut is in contact with the armature and the valve member, which are out of contact with each other.

4. The valve assembly of claim 1 wherein the valve member is trapped to move between a stop surface and a flat valve seat.

5. The valve assembly of claim 4 wherein the stop surface is a conical valve seat; and the valve member is in guiding contact with the valve body.

6. The valve assembly of claim 1 wherein the valve member includes a non-weldable and a non magnetic portion;

the nut includes a weldable portion; and the armature includes a magnetic portion and a weldable portion welded to the weldable portion of the nut.

7. The valve assembly of claim 6 wherein the armature is in contact with the nut over an orientation neutral interface;

the nut is in contact with the armature and the valve member, which are out of contact with each other;

the valve member is trapped to move between a stop surface and a flat valve seat;

the stop surface is a conical valve seat; and the valve member is in guiding contact with the valve body.

8. A fuel injector comprising:

an injector body including a stack of components that includes a valve body of a valve assembly in contact between a coil component and a needle control component at first and second stacking planes, respectively, that are parallel to each other; and the valve assembly including a valve member with a set of external threads and a shoulder stop, a nut threadably attached to the set of external threads at a first diameter and in contact with the shoulder stop, and an armature affixed to the nut at a second, larger diameter, and having a surface defining an air gap plane parallel separated from the first stacking plane by an air gap.

9. The fuel injector of claim 8 wherein the valve member includes a relatively non-weldable and a relatively non magnetic portion;

the nut includes a weldable portion; and the armature includes a magnetic portion and a weldable portion welded to the weldable portion of the nut.

10. The fuel injector of claim 9 wherein the valve member is trapped to move between a first position in contact with a conical seat on the valve body and contact with a flat seat on the needle control component; and the flat seat lying in the second stacking plane.

11. The fuel injector of claim 9 including a direct control needle valve with a closing hydraulic surface exposed to fluid pressure in a needle control chamber disposed in the needle control component; and the valve member being movable between a first position at which the needle control chamber is fluidly connected to a low pressure passage, and a second position at which the needle control chamber is blocked from the low pressure passage.

12. The fuel injector of claim 11 including a cam driven plunger and an electronically controlled spill valve.

13. The fuel injector of claim 12 wherein the armature is in contact with the nut over an orientation neutral interface;

the nut is in contact with the armature and the valve member, which are out of contact with each other; and the valve member is in guiding contact with the valve body.

14. A method of assembling a valve for a fuel injector, comprising the steps of:

inserting a threaded end of valve member through a guide bore of a valve body;

threading a nut onto the threaded end of the valve member until the nut contacts a stop shoulder on the valve member;

positioning a surface of an armature that defines an air gap plane in parallel with, and at an air gap distance from, a stacking plane defined by a contact surface of the valve body;

fitting the armature onto the outer surface of the nut with an interference fit; and affixing the armature to the nut via a weld.

15. The method of claim 14 wherein the fitting step includes mating the armature on a neutral orientation surface of the nut.

16. The method of claim 15 wherein the positioning step includes setting the parallel orientation and the air gap distance by contacting the armature with a fixture; and removing the valve from the fixture after the welding step.

17. The method of claim 16 including a step of clamping the valve body in the fixture.

18. The method of claim 17 wherein the fitting step includes pushing on an end of the valve member opposite from the threaded end until the valve member contacts a stop surface on the valve body.

19. The method of claim 18 including a step of positioning a coil component in contact with the contact surface of the valve body in the stacking plane.

20. The method of claim 19 including a step of positioning a spring to bias the armature away from the coil component.

* * * * *